United States Patent [19]

Shein

[11] 4,053,995

[45] Oct. 18, 1977

[54] ORTHOPEDIC SHOE

[76] Inventor: Melvin Shein, 6406 Regal Road, Louisville, Ky. 40222

[21] Appl. No.: 708,140

[22] Filed: July 23, 1976

[51] Int. Cl.[2] ..... A43B 7/14; A43B 23/26; A43B 13/12

[52] U.S. Cl. ..... 36/88; 36/54; 36/30 R

[58] Field of Search ..... 36/83, 25 R, 30 R, 43, 36/44, 50, 54, 28, 129, 88

[56] References Cited

U.S. PATENT DOCUMENTS

| | | | |
|---|---|---|---|
| 716,528 | 12/1902 | Flowers | 36/54 |
| 975,576 | 11/1910 | Sexton | 36/43 |
| 1,564,232 | 12/1925 | Golden | 36/129 |
| 2,007,157 | 7/1935 | Cockrum | 36/54 |
| 2,359,681 | 10/1944 | Rovick | 36/30 R |
| 2,648,855 | 8/1953 | Midgley et al. | 36/25 R |

*Primary Examiner*—Patrick D. Lawson
*Attorney, Agent, or Firm*—Berman, Aisenberg & Platt

[57] ABSTRACT

An orthopedic shoe including: a flat, level sole having a peripheral shape corresponding to that of the bottom plane of a foot and whose toe portion is very broad and of substantially constant width, whose central, metatarsal portion curves rapidly inwardly to a narrow neck connecting the toe portion with a heel portion, the ratio of the widths of the toe and heel portions being approximately 100 to 60, and the ratio of the toe portion to the neck of the central portion being approximately 100 to 40, the inner sole being formed in a plurality of layers at least of one of which is of compressible material capable of permanently conforming to the shape of the bottom of a foot under pressure of wearing; combined with an upper having a counter, a vamp and a toe portion, the vamp including a pair of widely spaced forwardly projecting flaps each including a row of eyelets and extending along the upper parts of the sides of the foot, the toe portion having a wide rearwardly extending tongue for covering the metatarsal arch and including a plurality of openings freely passing a lacing which adjustably connects the flap eyelets; the size, shape and arrangement of the sole, the upper and particularly the vamp, tongue and lacing being such that the shoe fits a foot in a glove-like manner supporting all parts of the foot uniformly and naturally.

18 Claims, 8 Drawing Figures

FIG. 4.
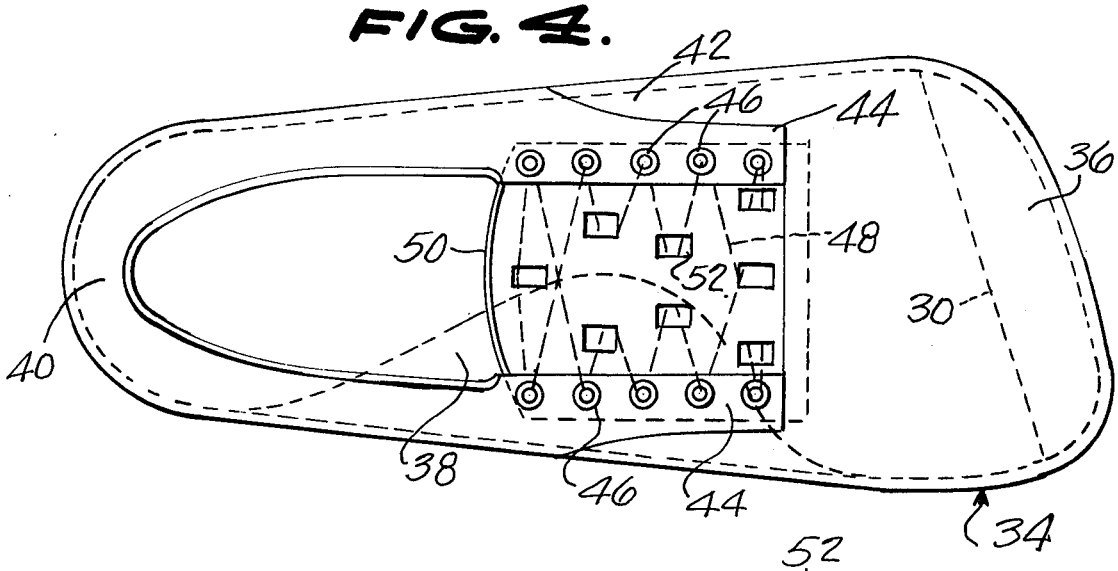
FIG. 5.
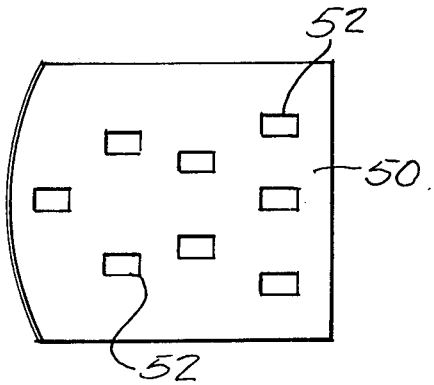
FIG. 6.
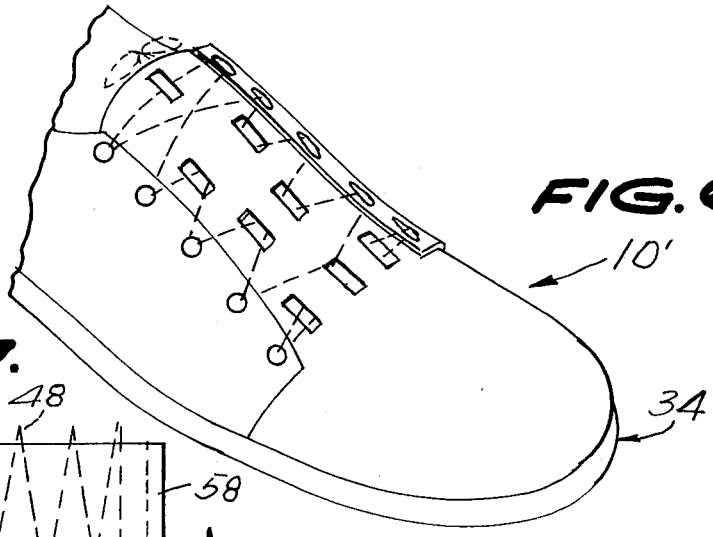
FIG. 7.
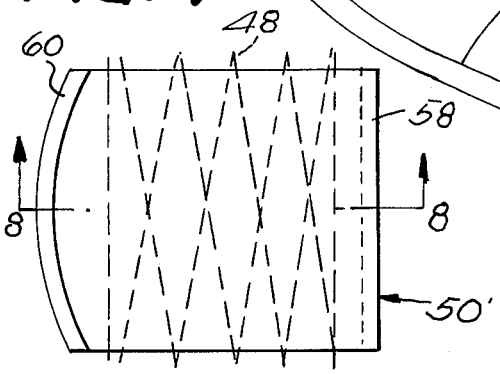
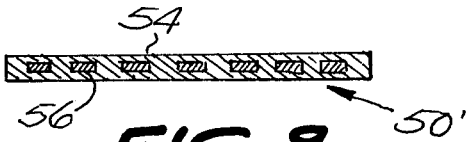
FIG. 8.

ORTHOPEDIC SHOE

FIELD OF THE INVENTION

The present invention relates to an orthopedic shoe which closely fits and comfortably supports the foot of a wearer in a natural manner without resulting in undue pressure on any part of the foot.

DESCRIPTION OF THE PRIOR ART

Mass produced conventional shoes normally include elevated heels, or in some instances depressed heels, thus detrimentally departing from a flat sole corresponding to the plane of the bottom of the foot. The soles and attached uppers normally are broadest in the area of the metatarsal-phalange joints and then narrow considerably, sometimes to nearly a point, thus squeezing and deforming the toes of the wearer, and lessening the support as well as causing sensitive and irritating callouses. A further disadvantage of these shoes is the failure of the soles to deform at the six points of major pressure exercised during standing and walking, which six points correspond to the junctures of the toes with the metatarsus including the two sesamoid bones connecting the large toe. As a result, the conventional shoe forces the foot to fit the shoe and causes deformations of the foot that are painful. Such shoes are impossible to be worn by persons having weak feet or other serious foot problems including callouses and bunions. These persons can only be helped by custom molded shoes which are very, very expensive.

SUMMARY OF THE INVENTION

It is a primary object of the present invention to provide a natural form shoe which overcomes the above briefly described defects and disadvantages of conventional shoes.

It is another important object of the invention to provide an orthopedic shoe whose sole corresponds to the bottom of the wearer's foot and thus forces the shoe to fit the foot rather than the foot to fit the shoe as in conventional shoes.

Another important object of the invention is to provide a shoe, having the above-described characteristics, whose sole is flat and whose innersole fomred in layers at least one of which is of a compressible material so as to permanently conform to the shape of the underside of the foot under weight of the wearer and which layer, or another layer, is sufficiently resilient to properly support the six pressure points of the foot, thereby eliminating or preventing the formation of callouses and bunions and producing equalized weight distribution.

Still another object of the invention is to provide a shoe having a flexible upper, whose vamp underlies and supports the metatarsal arch, and which includes a pair of forwardly projecting widely spaced side flaps having eyelets for lacing, and a broad tongue extending rearwardly from the toe portion of the upper to cover the metatarsal arch between the said flaps, the tongue having one or more large openings through which the lacing freely passes, the construction and arrangement being such that the tongue and vamp side flaps fit closely in glovelike fashion nearly completely about the metatarsal arch lifting and supporting the same without unnatural pressure.

Yet, another object of the invention is to provide an orthopedic shoe, having the above-described characteristics, which is equivalent in fit and support to a custom molded shoe cast to fit exactly the shape of an individual's foot, but which can be produced by mass production processes and which thereby achieves the benefits of a custom molded shoe at vastly reduced cost to the purchaser.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

FIG. 4 is a top plan view of the mate of the shoe illustrated in FIG. 1;

FIG. 5 is a fragmentary plan view of the shoe tongue alone;

FIG. 6 is a perspective view of a second embodiment of the shoe of the invention;

FIG. 7 is a plan view, similar to FIG. 5, but showing a modified shoe tongue; and FIG. 8 is a cross-sectional view taken on line 8—8 of FIG. 7.

DESCRIPTION OF THE PREFERRED EMBODIMENTS

Figure 1:
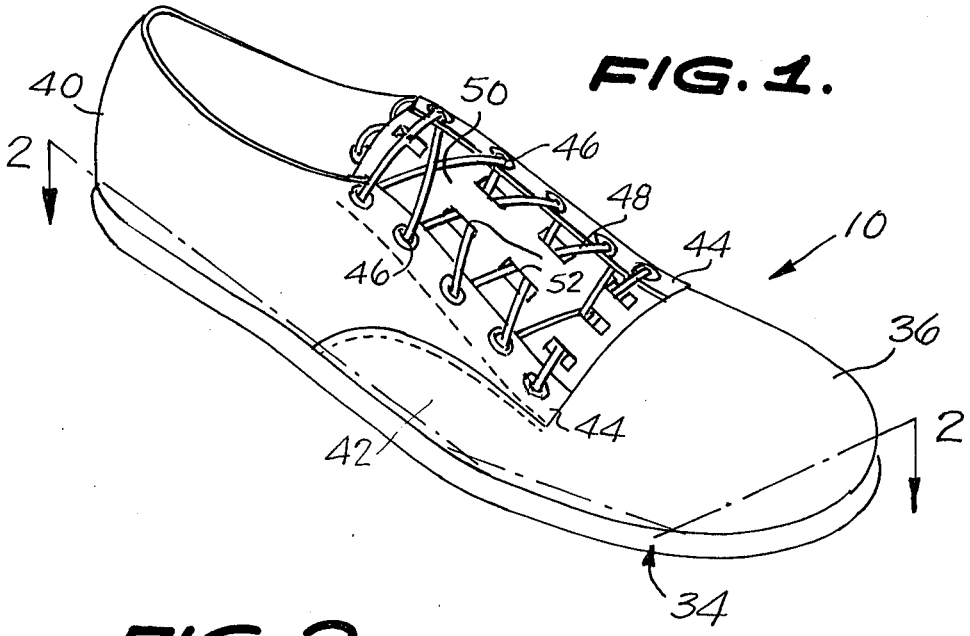
FIG. 1 is a perspective view of an orthopedic shoe constructed in accordance with the invention.

Referring more particularly to the drawings, a preferred embodiment of the invention is illustrated in FIG. 1 as comprising an orthopedic shoe generally indicated by the reference numeral 10. To understand the invention, it is explained that the structure of the shoe is dictated by the structure of the inner sole generally indicated by the reference numeral 12, and which is best seen in FIGS. 2 and 3.

Figure 2:
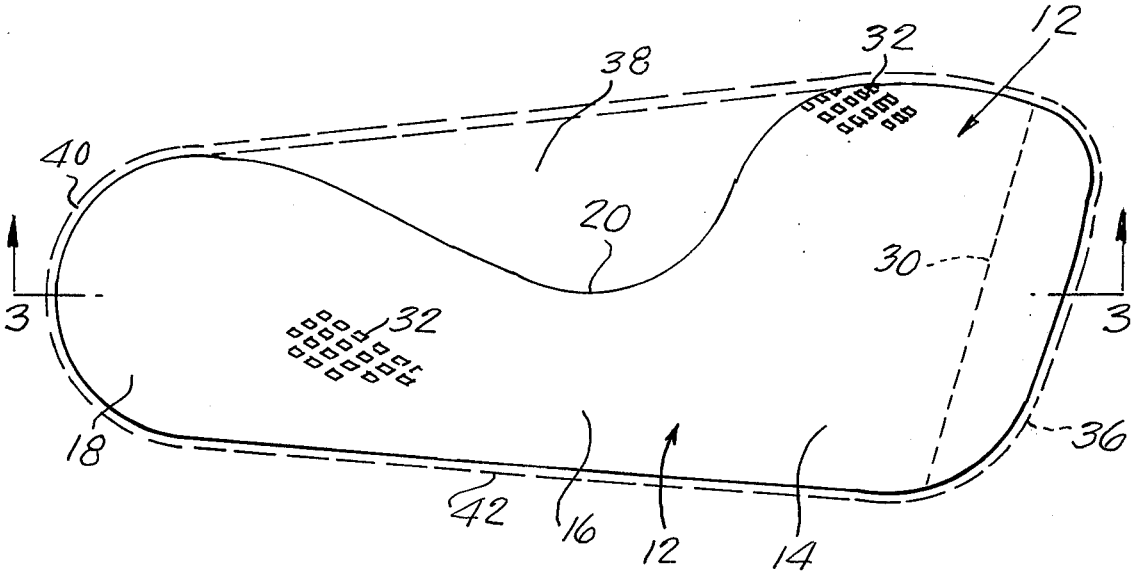
FIG. 2 is a plan view of the inner sole taken on line 2—2 of FIG. 1, and showing the outer sole and upper in broken lines.
Figure 3:
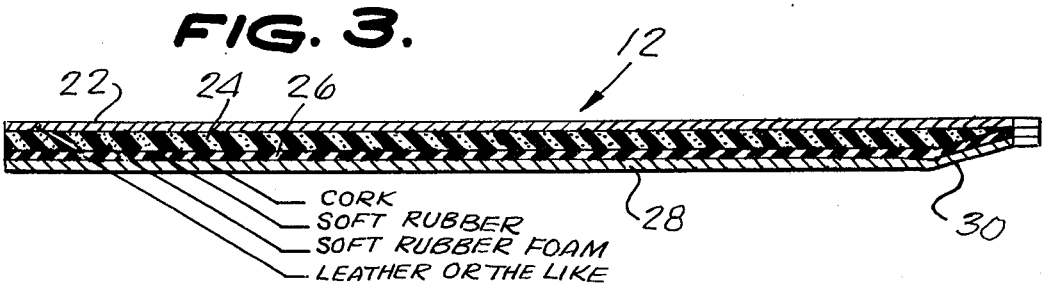
FIG. 3 is a vertical sectional view of the inner sole only taken on line 3—3 of FIG. 2 and omitting the flat outer sole.

Inner sole 12, shown in full lines in FIG. 2, includes a very broad anterior transverse arch portion 14, a rapidly inwardly curving and narrowing metatarsal portion 16 and a heel portion 18. The peripheral contour of the inner sole conforms exactly to that of the horizontal bottom plane of a human foot so that the inner sole is much narrower than the conventional shoe sole at its neck portion 20 under the metatarsal arch of the wearer's foot. Thus, as will become apparent later, the shoe relies upon the upper which extends under the metatarsal arch to lift and support the wearer's arch. The anterior transverse arch or toe portion 14 of the inner sole is broad and of substantially constant width. Thus, the toes of the wearer are fully supported and are free to spread under weight exercised on the sole during walking and running without squeezing of the toes together and without permanently deforming the toes in the manner prevalent with many conventional shoes. The heel portion 18 of the inner sole is of conventional shape. It has been found that the configuration of the inner sole as thus briefly described is best suitable for most wearers when the width of the transverse anterior arch, the minimum width of the metatarsal portion of the sole and the width of the heel portion of the sole are in the approximate ratio of 100 to 40 to 60.

It is highly desirable that the inner sole be level and flat as is the bottom of the human foot, in contrast to the use of an elevated or depressed heel, both of which are detrimental to the wearer. To this end, the inner sole 12 may be formed of a plurality of relatively thin flat layers as shown in FIG. 3. The top layer 22 is formed of a flexible leather lining or other suitable material. The second layer 24 is formed of a soft rubber foam material, which is resilient and compressible and preferably such that with use permanent depressions will be molded into the sole by pressure at the six major pressure points of the foot, corresponding to the junctures of the toes with the metatarsus including the two sesamoid bones. Beneath the foam rubber layer is placed a thin layer 26 of soft rubber, and below this layer another thin layer of cork 28 completes the inner sole. The cork like the rubber foam is resilient and somewhat permanently compressible so that it deforms to form cavities at the pressure points of the bottom of the foot. The described layers are glued or cemented together to form the inner sole. Desirably, the extreme front portion of the inner sole is beveled upwardly from the bottom line 30 to ease and aid the walking process and reduce the flexing of the inner sole during such action. If, however, a thinner sole is desired, the bevelling may be omitted. It has been found that a suitable thickness for each of the layers 22, 26 and 28 is approximately 1/16 inch, while a suitable thickness for the soft foam rubber layer 24 is approximately one-eighth inch. While the inner sole has been described as having four layers, it should be apparent that more or fewer layers may be utilized, and other suitable materials may be used. The layer of cork 28, for example, may be omitted so long as one of the remaining layers such as the soft foam rubber layer 24 is capable of resiliently supporting and permanently conforming to the shape of the underside of the foot. It further may be desirable to perforate the inner sole from top to bottom, or at least through the three underlayers, with a plurality of non-circular openings 32 which permit the inner sole to more readily conform to the shape of the bottom of the foot and to form permanent depressions at the major pressure areas. Some conventional inner soles are perforated but normally these utilitize round openings which tend to collapse on themselves. Accordingly, the preferred shape of the perforations 32 is square, triangular or rectangular.

An outer sole 34 is provided which has exactly the same peripheral shape as the inner sole 12 and which is also relatively thin and flat but may vary in thickness depending on the material used for the outer sole. The outer sole is secured to the inner sole and to the shoe upper by any conventional method, none of which need illustration or description herein. Since the outer sole 34 is flat, the heel of the wearer will not be elevated or depressed and the bottom of the foot is firmly supported in its natural, horizontal, flat state.

The shoe is completed by a flexible leather upper which differs from conventional uppers in several important aspects. Firstly, the toe portion 36 of the upper conforms in shape to the wide transverse anterior arch portion of the inner sole 12 and is also of substantially constant width from front to rear. At the rear of the toe portion it is integrally formed or connected to a flap 38 which may be considered to be a part of the vamp of the shoe and which has a bottom edge which is curved to conform to the shape of the contiguous central portion of the inner sole 12. The rear of this portion 38 is integrally secured to the heel portion 40 of the upper. The vamp on the opposite side of the part 38 is more or less rectangular in shape as indicated by reference numeral 42. Projecting forwardly from the heel portion 40 are a pair of widely spaced flaps 44 each having a longitudinal line of fastening devices illustrated as being eyelets 46 for passage of a lacing 48.

A broad, generally rectangularly shaped tongue 50 is integrally formed on the toe portion 36, or secured thereto to extend rearwardly over the metatarsal arch and thus complete the vamp portion of the upper. The tongue has suitably arranged therein a plurality of large rectangular openings 52 passing therethrough from top to bottom and which serve to freely pass the lacing 48. When the lacing is tightened on the foot of the wearer, the free passage of the lacing through the apertures 52 prevent the tongue 50 from wrinkling or otherwise unduly binding the arch of the foot. It should be further noted that since the lacing eyelets in the flaps 44 are widely spaced, these flaps are pulled upwardly to a greater degree than they are pulled inwardly and a corresponding greater upper force is exercised on the portion 38 of the upper which lies under the metatarsal arch. Accordingly, the shoe vamp, when adjusted about the foot of the wearer by appropriate tying of the lacing 48, and comprising the parts 38, 42, flaps 44 and tongue 50 gently surround the metatarsal arch with the part 38 lifting and supporting the arch in a natural manner.

The modified embodiment of the invention illustrated in FIG. 6 in all respects is the same as the shoe shown in FIG. 1, except that the toe portion of the sole, the inner sole and the upper are slightly elongated and given an oval shape instead of a squared off front. This modified shoe 10' may have a rubber or crepe outer sole 34' and a canvas upper and will thus be suitable for use as a tennis shoe while still incorporating the foot cradling and support features of the shoe described above and illustrated in FIG. 1. Obviously, with other minor modifications, such as by addition of spikes or cleats, the shoe may be adapted for use with other sports such as track, golf, and the like.

A modified shoe tongue 50' having the same attributes as the tongue 50 is illustrated in FIGS. 7 and 8. This tongue is formed of two thin layers 54 and 56 mounted one above the other and preferably secured to each other along their forward and rear edges 58 and 60. This leaves a space between the layers 54 and 56 which permits the free passage of the lacing from side to side of the tongue, and such lacing is free to be adjusted without wrinkling the tongue. Furthermore, the lacing is substantially hidden by the described construction.

It is pointed out that the orthopedic shoe of the invention as described above is naturally formed to the shape of the foot, and supports all parts of the foot in a natural manner without undue pressure in any area. Thus, the shoe conforms to the foot rather than vice-versa. The construction and arrangement is such that the entire foot is closely surrounded and supported in a glove-like manner. Particular note should be taken that the shoe provides for transverse and longitudinal arch support in an anatomic manner, and the structure is such that the lacings are supported by the tongue so that the tongue becomes a portion of the vamp which supports the arch of the foot. At the same time the tongue protects the foot from unduly high pressure along the length of the lacing. The tongue may vary in width from approximately 2-7/8-inches to 4-inches depending upon the width, type and contour of the shoe. The tongue opening between the flaps 44 may be varied from approximately 1¾-inches to 2½-inches depending upon the width and size of the shoe.

It should be further obvious that the construction of the shoe is such that it may be used as a dress shoe and may be modified slightly by additions and ornaments to the upper so as to appeal to those who are conscious of style. For example, the modifications may include those applicable to blucher, wing tip, saddle shoes or sandals.

While the fastener and fastener devices described are the lace and eyelet type, it should be further obvious that other equivalents may be used in replacements such as zippers, elastics, velcro and hook eyes. The above-described tongue opening may if desired be located on the side of the shoe.

Although certain embodiments of the invention have been shown and described, it is obvious that many modifications thereof are possible. The invention, therefore, is not intended to be restricted to the exact showing of the drawings and description thereof but is considered to include reasonable and obvious equivalents.

What is claimed is:

1. An orthopedic shoe comprising in combination: a flat, level sole whose periphery has the same shape as that of the bottom horizontal plane of a foot and includes an anterior transverse arch portion which is broad and of substantially constant width, a rapidly inwardly curving and narrowing metatarsal portion, and a heel portion, said sole including a compressible, permanently foot conformable layer; and an upper including a heel counter, a vamp for embracing the sides and under the metatarsal arch, said vamp having a pair of widely spaced forwardly projecting flaps for extending along the upper parts of the sides of a foot, each flap including a longitudinal row of fastener devices, and a toe portion having a broad rearwardly extending tongue to cover the metatarsal arch, said tongue having upper and lower connected layers and at least one large transverse opening to freely pass an adjustable fastener therethrough for cooperation with said fastener devices, whereby the shoe closely conforms to the shape of a foot and supports all parts of the same in a uniform natural manner.

2. An orthopedic shoe according to claim 1, wherein the widths of the anterior transverse arch and heel portions of said sole are in the approximate ratio of 100 to 60, and the ratio of the width of the anterior transverse arch portion to the minimum width of the metatarsal portion of said sole is approximately 100 to 40.

3. An orthopedic shoe according to claim 1, wherein said sole is made of a plurality of flat layers secured together.

4. An orthopedic shoe according to claim 3, wherein said sole layers include, from top to bottom, leather, soft rubber foam, soft rubber and cork, respectively.

5. An orthopedic shoe according to claim 3, wherein said sole layers include, from top to bottom, leather, soft rubber foam and soft rubber, respectively.

6. An orthopedic shoe according to claim 3, wherein said sole is provided with areas including a plurality of noncircular openings therethrough to aid in pressure conforming the sole to the shape of the bottom of a foot.

7. An orthopedic shoe according to claim 3, wherein said fastener devices are eyelets and said fastener is a lace which passes through said openings of the tongue, whereby to lift the vamp into metatarsal arch supporting position without wrinkling said tongue.

8. An orthopedic shoe according to claim 7, wherein said openings in the tongue extend therethrough from top to bottom and are considerably larger than the lace which passes freely through them.

9. An orthopedic shoe according to claim 7, wherein said upper and lower layers are secured together at their forward and rear edges and said at least one large transverse opening extends from side to side for passage of said lace transversely between the layers.

10. A shoe sole comprising a plurality of flat, horizontal layers secured together whose periphery has the same shape as that of the bottom horizontal plane of a foot and includes an anterior transverse arch portion which is broad and of substantially constant width, a rapidly inwardly curved and narrowing metatarsal portion, and a heel portion, one of said layers being formed of a compressible material capable of deforming under pressure to permanently conform to the shape of the bottom of a foot, the widths of the said anterior arch and heel portions being in the approximate ratio of 100 to 60, and the ratio of the width of the transverse arch portion to the minimum width of the metatarsal portion being approximately 100 to 40.

11. A shoe sole according to claim 10, wherein said sole layers include, from top to bottom, leather, soft rubber foam, soft rubber and cork, respectively.

12. A shoe sole according to claim 10, wherein said sole layers include, from top to bottom, leather, soft rubber foam and soft rubber, respectively.

13. An orthopedic show according to claim 3, wherein said sole is beveled upwardly and forwardly from a line lying approximately under the metatarsal — phalange joints.

14. An orthopedic shoe comprising in combination: a flat, level sole having upper and lower substantially parallel planar surfaces and whose periphery has substantially the same shape as that of the bottom horizontal place of a foot and includes an anterior transverse arch portion which is broad and of substantially constant width, a rapidly inwardly curving and narrowing metatarsal portion, and a heel portion; and an upper which includes broad tongue means for covering the metatarsal arch, said tongue means having aperture means formed thereon for passing an adjustable fastener transversely therethrough, said aperture means comprising a plurality of large openings formed in said tongue means from the top to the bottom thereof.

15. The orthopedic shoe according to claim 14, wherein the widths of the anterior transverse arch and heel portions of said sole are in the approximate ratio of 100 to 60, and the ratio of the width of the anterior transverse arch portion to the minimum width of the metatarsal portion of said sole is approximately 100 to 40.

16. The orthopedic shoe according to claim 14, wherein said fastener comprises a lace passing through said large openings.

17. The orthopedic shoe according to claim 16, wherein said openings in said tongue means are considerably larger than the lace which passes freely through them.

18. The orthopedic shoe according to claim 14, wherein said tongue means includes upper and lower layers secured together at their forward and rear edges which define at least one large transverse opening extending from side to side which comprises said aperture means for passage of said fastener transversely between said layers.

* * * * *